US009284516B2

(12) United States Patent
De Almeida

(10) Patent No.: US 9,284,516 B2
(45) Date of Patent: Mar. 15, 2016

(54) COMPOSITION FOR CLEANING, PROTECTING AND REVITALIZING SURFACES IN GENERAL AND THE PRODUCT OBTAINED THEREFROM

(71) Applicant: Demoiselle Indústria e Comércio de Produtos Para Revitalização Ltda., São Carlos (BR)

(72) Inventor: Davinci Lourenço De Almeida, Guarulhos (BR)

( * ) Notice: Subject to any disclaimer, the term of this patent is extended or adjusted under 35 U.S.C. 154(b) by 99 days.

(21) Appl. No.: 14/293,282

(22) Filed: Jun. 2, 2014

(65) Prior Publication Data

US 2015/0232788 A1 Aug. 20, 2015

Related U.S. Application Data

(63) Continuation of application No. PCT/BR2014/000108, filed on Mar. 21, 2014.

(30) Foreign Application Priority Data

Feb. 18, 2014 (BR) ..... 10 2014003807

(51) Int. Cl.
*C11D 3/39* (2006.01)
*C11D 3/12* (2006.01)

(52) U.S. Cl.
CPC ..... *C11D 3/3942* (2013.01); *C11D 3/124* (2013.01)

(58) Field of Classification Search
CPC ..... C11D 3/124; C11D 3/14; C11D 3/1206; C11D 1/62; C11D 3/1246; C11D 11/0023; C11D 3/3942
See application file for complete search history.

(56) References Cited

U.S. PATENT DOCUMENTS

2006/0269441 A1* 11/2006 Ochomogo ..... A01N 33/12 422/28
2008/0146478 A1* 6/2008 Lei ..... A61K 8/11 510/119
2009/0011222 A1* 1/2009 Xiu ..... C23C 18/00 428/323
2009/0176678 A1* 7/2009 Zeisbrich ..... C11D 7/10 510/243
2009/0214447 A1* 8/2009 Jennings ..... A61K 8/11 424/49
2009/0252691 A1* 10/2009 Gartstein ..... A61K 8/11 424/49
2011/0033513 A1* 2/2011 Lei ..... A61K 8/11 424/401
2013/0095042 A1* 4/2013 Weitzmann ..... A61K 9/5115 424/9.6
2013/0267453 A1* 10/2013 Wates ..... C11D 3/124 510/438
2015/0203790 A1* 7/2015 Strerath ..... B08B 17/065 428/428
2015/0232788 A1* 8/2015 De Almeida ..... C11D 3/3942 510/365

* cited by examiner

*Primary Examiner* — Gregory Webb

(57) ABSTRACT

The present invention is directed to a composition for cleaning, protecting and revitalizing surfaces in general and the product obtained therefrom, pertaining to the field of chemistry, more particularly to a composition based on water, silica, hydrogen peroxide, trimethyl ammonium chloride and a fragrance, thus forming a non-abrasive product able to breakdown oil molecules, greases, and it may be applied to surfaces of any nature having or not soil on same, the purpose of which is to clean, protect and revitalize original characteristics thereof, such as brightness and texture, and it may be applied to painted and/or polished surfaces as well, so that such a surface becomes hydrophobic.

5 Claims, No Drawings

COMPOSITION FOR CLEANING, PROTECTING AND REVITALIZING SURFACES IN GENERAL AND THE PRODUCT OBTAINED THEREFROM

CROSS REFERENCE TO RELATED APPLICATIONS

This application is a Continuation of International Application No. PCT/BR2014/000108, filed Mar. 21, 2014 (which is hereby incorporated by reference).

The present invention discloses a composition for cleaning, protecting and revitalizing surfaces in general and the product obtained therefrom, pertaining to the field of chemistry, more particularly to a composition based on water, silica, hydrogen peroxide, trimethyl ammonium chloride and a fragrance, thus forming a non-abrasive product able to breakdown oil molecules, greases, and it may be applied on surfaces of any nature, having or not soil thereon, the purpose of which is to clean, protect and revitalize original characteristics thereof, such as brightness and texture, and it may be applied to painted and/or polished surfaces as well, so that such a surface becomes hydrophobic.

BACKGROUND OF THE INVENTION

The surfaces have usually a lot of soil particles thereon, usually suspended natural elements plus a number of acidic chemicals.

A large number of particulates derived from soot, air dampness and vapors is launched into the atmosphere as the result of several human activities, thus generating a harmful and highly abrasive environment in the cities, a picture that can easily be perceived by simply paying close attention to monuments and buildings in urban areas of any metropolis.

Microscopically, when a particle suspended in the air, plus the relative humidity thereof, contacts a surface along its trajectory it tends to penetrate into the pores present throughout such a surface.

Thus, in the market there are several protecting and cleansing agents to be used on different surfaces that make them hydrophobic. However, all of such products in the market are based on petroleum or derivatives thereof, thus causing great harm to the environment where they are produced and used, besides being expensive products due to the raw material employed for making same.

With relation to the surfaces of aircrafts, mention may be made to the object of patent PI1001175-7 of the same applicant, wherein a non-abrasive product is formulated that can be applied to surfaces in general having or not soil thereon, for the purpose of cleaning, protecting and preserving the original characteristics thereof, such as brightness and texture, and it may be applied to painted and/or polishing surfaces as well, and it is comprised of a liquid non-toxic non-flammable fire resistant water-soluble product that consists of dipropylene glycol, mineral oil, propylene glycol, sodium-based solution, coloring agent, trimethyl ammonium chloride, distilled water, dialkyl chloride, grape fragrance, and water.

However, such product neither makes the surface fully hydrophobic and provides a full change nor breaks down the molecules of several oils mainly petroleum and derivatives thereof.

STATE OF THE ART

Thus, a composition was developed for producing a product that may be applied on metal, rubber, plastic, masonry and glass surfaces, that can remove impurities besides changing and breaking down several molecules of oil mainly petroleum and derivatives thereof, thus making such a surface fully hydrophobic.

When the product, that may be liquid or pasty, is applied to the surface to be treated, it penetrates into the fissures, encapsulating same and removing the particulate material impregnated therein, thus restoring the original conditions of the surface, the result of which is a homogeneous protective layer.

Also, when the product is applied to a solid surface or a surface having water and oil thereon, it starts a process of breaking down the molecules through physical reaction or mechanical action. The present invention discloses a composition based on water, silica, hydrogen peroxide, trimethyl ammonium chloride and fragrance that, by acting altogether, encapsulate the oil molecules through an electrostatic interaction and repel the encapsulated oil by reverting the polarity of the surface it was applied to, so that the residue is degraded forming carbon and oxygen molecules that are not harmful to the environment after the application thereof.

Thus, the object of the present invention is to eliminate, clean, protect and revitalize any type of surface and also provide a fully hydrophobic characteristic, which is attained by penetrating the micro-fissures on the surface to be treated, encapsulating same and removing the impregnated particulate material therefrom, thus cleaning such fissures, and then reconstituting the layer formed by the original protective film on the surface.

Another aspect of the invention is the creation of a perfectly homogeneous film all over the surface, irrespective of the material said surface is made of, mainly in areas having irregularities or surface roughness. Such a film should be sufficiently smooth, thus preventing the particulate material present in the air from being deposited thereon, even in a situation involving a direct frontal collision, so that the colliding particulate material can be diverted therefrom.

In the event of painted surfaces, the invention proposed herein is able to promote the revitalization of the painting of the surface, providing same with a mirror-like brightness without, however, removing the burnt painting, thus keeping the original paint layer.

Finally, the product obtained through the composition of the present invention has a cumulative effect since each time it is applied the resistance of the protective film increases, and in regular applications it assures that the parts that are worn out more significantly can be completely restored, thus keeping the layer homogeneous and uniform all over the surface it is applied to.

With relation to environmental issues, the product is highly beneficial to the environment, since, due to the fact that it does not contain any pollutant, residues are not left and the need to wash the surfaces constantly—a procedure that is intensively adverse to the environment, both in relation to the high consumption of treated water and the incorporation of residues to the served water—is reduced drastically.

Another object of the present invention is to provide a product that integrates a technology able to fulfill all the aspects related to the preservation of the environment, since it does not pollute the environment at all, and makes it possible to save water, thus providing a reduction in the residual particles present in the water used for washing surfaces in general.

Moreover, the product does not pose any risk to both the person who will apply same to the surface to be treated and the surface itself, and, as consequence, it will also not pose any risk to the environment when analyzed from the point of view of the place where it is produced or applied since, during the process of manufacturing and application thereof, vapors, gases or residues are not generated, and thus the present composition has a reduced amount of chemicals when compared to the products that are usually developed for the treatment of surfaces.

DETAILED DESCRIPTION OF THE INVENTION

The present invention has the following composition:

Water—from 50.0 to 91.98% by volume;

Nano-silica (colloidal or dust)—from 5.0 to 7.99% by mass;

Hydrogen peroxide—from 0.01 to 2.0% by volume;

Trimethyl ammonium chloride—from 3.0 to 39.99% by volume; and

Fragrance—from 0.01 to 0.02% by volume.

The thus obtained product has a minimum viscosity of 300 ctsk, a pH varying between 6.0 and 8.5 and a minimum density of 0.90 g/cm$^3$, thus providing a 99.9% hydrophobic surface able to break down molecules of petroleum derivatives in a pasty or liquid state.

EXEMPLARY APPLICATION

An exemplary use of the invention applied to glass and masonry surfaces is given hereinbelow, where use was made of the following composition:

Water—70.0% by volume;

Nano-silica (dust)—6.5% by mass;

Hydrogen peroxide—1.5% by volume;

Trimethyl ammonium chloride—21.99% by volume; and

Fragrance—0.01% by volume.

The result was a product having a viscosity of 315 ctsk, a pH of 7.0 and a density of 0.90 g/cm$^3$, thus providing a 99.9% hydrophobic surface in a liquid state, and when it was applied to a masonry and glass surface of a building façade it removed all the impurities, cleaned the fissures, thus attaining a non-impregnated surface protected against newly formed soil, preserving the original characteristics thereof.

ADVANTAGES ATTAINED BY THE INVENTION

The product obtained through the composition and process described above offers the following extraordinary advantages:

Low water consumption when cleaning the many cited surfaces;

Protection of surfaces;

Crystallization, mirror-like appearance and vitrifaction;

Full hydrophobicity of the surfaces it was applied to;

Maximum removal of oils, fats, greases and waxes of every nature, by breaking down the molecules thereof;

It is totally non-toxic to the environment from the manufacturing process to the several ways of application;

It is non-toxic to the health of humans from the manufacturing process to the final use;

It dispenses with the use of protection equipment, such as gloves and masks;

It removes materials, nano- and micro-particles from the surfaces it is applied to.

The scope of the present invention should not be limited to the example, but to the terms defined in the attached claims and its equivalents.

The invention claimed is:

1. A composition for cleaning, protecting and revitalizing surfaces in general, characterized by comprising the following composition:

Water—from 50.0 to 91.98% by volume;

Nano-silica—from 5.0 to 7.99% by mass;

Hydrogen peroxide—from 0.01 to 2.0% by volume;

Trimethyl ammonium chloride—from 3.0 to 39.99% by volume; and

Fragrance—from 0.01 to 0.02% by volume.

2. The composition according to claim 1, characterized in that the nano-silica is present in the form of a colloid or dust.

3. A product having a minimum viscosity of 300 ctsk, a pH varying between 6.0 and 8.5 and a minimum density of 0.90 g/cm$^3$, characterized in that it is obtained in compliance with the composition according to claim 1 thus providing a 99.9% hydrophobic surface.

4. The product according to claim 3, characterized in that it is able to break down molecules of petroleum derivatives.

5. The product according to claim 3, characterized in that it is in a pasty or liquid state.

* * * * *